US011555328B2

(12) United States Patent
Perry

(10) Patent No.: US 11,555,328 B2
(45) Date of Patent: Jan. 17, 2023

(54) FENCE RAIL COMBINATION TOOL

(71) Applicant: Richard Perry, Trowbridge (GB)

(72) Inventor: Richard Perry, Trowbridge (GB)

( * ) Notice: Subject to any disclaimer, the term of this patent is extended or adjusted under 35 U.S.C. 154(b) by 314 days.

(21) Appl. No.: 13/751,174

(22) Filed: Jan. 28, 2013

(65) Prior Publication Data

US 2014/0138891 A1 May 22, 2014

Related U.S. Application Data

(60) Provisional application No. 61/591,865, filed on Jan. 28, 2012.

(51) Int. Cl.
*E04H 17/26* (2006.01)

(52) U.S. Cl.
CPC ..... *E04H 17/26* (2013.01)

(58) Field of Classification Search
CPC ..... E04H 17/26
USPC ..... 296/3, 6, 36, 41, 46, 95, 143; 256/1, 59, 256/65.06, 71; 411/441, 482; 248/60, 248/74.3
See application file for complete search history.

(56) References Cited

U.S. PATENT DOCUMENTS

| | | | | | |
|---|---|---|---|---|---|
| 183,601 | A * | 10/1876 | Stover | 256/68 |
| 305,776 | A * | 9/1884 | Amstutz | 269/36 |
| 339,266 | A * | 4/1886 | Clark | 256/71 |
| 368,098 | A * | 8/1887 | Mahon | 256/71 |
| 873,198 | A * | 12/1907 | Wilson | 248/62 |
| 3,032,305 | A * | 5/1962 | Mittenzwei | 248/62 |
| 4,944,494 | A * | 7/1990 | Pendleton | 256/68 |
| 5,590,859 | A * | 1/1997 | Lord | 248/62 |
| 5,673,903 | A * | 10/1997 | Lewis | 269/41 |
| 7,162,790 | B1 * | 1/2007 | Daniels | 29/525.01 |
| 8,407,872 | B2 * | 4/2013 | Powell et al. | 29/239 |
| 2012/0080566 | A1 * | 4/2012 | Pauchet et al. | 248/74.3 |

* cited by examiner

*Primary Examiner* — Joshua Kennedy

(57) ABSTRACT

A fence rail combination tool for supporting a fence rail during fixing comprising an elongated main body, a tip, and a head to retain at least one strap upon the elongate body said tip at a first end for piercing a fence post and an enlarged head at a second end, a lug or fin is incorporated on the body between the first end and the second end and has a slot or aperture therein receiving the strap, wherein the lug or fin acts as a stop to limit insertion of the tip into the fence post and acts to reduce, prevent or limit sagging of the tool under the weight of the supported rail.

46 Claims, 19 Drawing Sheets

FENCE RAIL COMBINATION TOOL

BACKGROUND OF THE INVENTION

This invention relates to A Fence Rail Combination Tool.

During my adventures constructing fencing and subsequently working alone; I have found a problem when trying to install fence rails upon and between fence posts.

Fence railings tend to be reasonably lengthy, generally having a minimum length of around ten feet and generally spanning over ten-twelve feet in length. The railings are attached to the fence posts which are commonly spaced a similar distance apart so that the rails and posts join together to construct the fence and create the boundary when the fence is complete.

The process of constructing the fence (in particular post and rail fencing) is this: the posts are firmly set in the ground and spaced approximately 12 feet apart. A minimum of two posts are needed to create one section of fence—one at each end of the rail. The workman then has to fix the rail(s) between the posts usually by hammering a nail through the rail into the post. Besides being fixed horizontally, the rails are generally also spaced vertically, several feet apart, up the post, which requires the workman to lift the rail up to the fence post (which is generally at least 4-6 ft high), and to then fix the rail to the post. The rails should be level or follow a parallel line to the ground for the fence to have maximum strength and stability and to be aesthetically pleasing to the eye.

Here's the problem: Imagine this: one man is trying to lift a 10 ft rail (which is fairly heavy), up six feet in the air, which he then has to line up perfectly between two fence posts that are spaced at least 5 ft away from either side of him, and then somehow using a hammer, he has to nail each end of the rail to the post and, if he's really good, simultaneously use a spirit level to ensure the rail is where he wants it, before he finally permanently fixes the rail to the post. It does not take a genius to work out that this is extremely difficult and more or less impossible without a second person.

The way I work around this is to try to hold the rail about mid point clutched under my arm whilst I hammer one end into the post and then, still clutching the rail, I turn around and fix the other end. With difficulty, this method does work, but the problem is that the rail will often not be level or it will be off course or not quite where it was supposed to be fastened. These small errors can have a large impact on the overall build of the fence and can make the fence way off line (despite how many times it's been marked out) especially if working to an incline or decline ground mark. It is possible to use clamps but then the rail cannot be freely adjusted and moved around to get a perfectly built fence. Also, when clients are observing one perform this balancing act, it makes one feel unprofessional, even if the final constructed fence is perfect.

There are also parts of the fence construction process (in particular with post and rail fencing), where the end of the rail is usually fastened to the centre of each post so that every post has two rails attached to it from each side of it, using the post as the central support point, obviously so that less posts are used etc. When one is working alone, each rail has to be held up to the post and marked off to be able to be cut if necessary and to ensure the rail is the correct length. This means that one has to measure the rail from the centre of the post often whilst holding the rail. Often measurements have to be taken from different sides of the post and the tape measure is often pulled and twisted around to get a rough measurement as often there are obstacles in the path of the tape such as plants, trees and bushes etc. The other problem is that it's often difficult to anchor the loose end of the tape measure and hold it in place against a post over such a long distance. There are also several different types of rail fencing with different types and sizes of timber and metal used such as rectangular timber or circular metal rails and any tool needs to be able to be used with a large range of rail types.

What is needed is an apparatus or tool that is releasably secured to the fence post and which temporarily tightly holds and/or suspends one end of the rail to the post by way of a strap or tie which may be adjustable to allow the rail to be moved and repositioned, so that the workman can fix the other end of the rail to the other post accurately and trouble free, which would therefore make the job easier, save time and labour. It means only one person is needed to construct the fence and not two. The tool could have a means of release or extracting it from the post as it would likely be temporarily nailed to the post which could be in the form of a hand grip used to pull the tool out of the post. There should also be provision for anchoring a tape measure which may be adjustable or have a range of movement to allow the tape to be held, adjusted and accurate measurements to be taken. There could also be provision to incorporate a mini spirit level and other parts incorporated such as stop lugs to stop the tool being pulled out by the weight of the suspended rail and thumb lugs etc. The tool could be made of several different pieces that could be put together as chosen by the workman for any particular fencing application, such as different types and lengths of straps and strap attachments to suit different types of rails. Sometimes longer straps are needed, stronger straps, adjustable straps, non adjustable straps and so on. The tool should make this fencing task safer to undertake, look more professional and ultimately provide a more accurately finished fence.

BRIEF SUMMARY OF THE INVENTION

According to the present invention there is provided a Fence Rail Combination Tool having a main body comprising a long single central shaft/pin with a head at the upper end of the pin and coming to a sharp point at the lower (or opposite) end/tip; purpose being that the body will be hammered into or secured around a fence post via the point and the upper head end will be struck by the hammer that forces the lower point end into the post. The central shaft which may be solid or hollow will receive and retain at least one strap and may have one or more hooks, holes or anchor points to attach said strap that may be releasable for the purpose of wrapping around and suspending the rail and then being tied or anchored back to the main body in order to secure the rail to the tool which is fixed to the post. The tool can be formed as one whole or can be made up of several parts put together via screw sections, push in sections or clip on sections as chosen by the workman to suit any particular fence rail application where the parts may be interchangeable and used for different purposes such as anchoring or receiving the end of a tape measure and using different straps for different types of posts and rails. The main shaft may have recesses, stops, channels, lips, holes, prongs, hooks that may be eyed, fins or lugs to allow different attachments and straps to fit to it and to act as pressure stops and/or means to extract the tool from the fence post and the point at the tip end could be either incorporated into the shaft or as an attachment to the shaft so that another attachment of a hoop or coupling to fit around metal circular posts could be used. The point is necessary for wooden posts as this is the driving/penetrating feature that pierces the wood to temporarily secure the tool in place on the post.

BRIEF DESCRIPTION OF THE SEVERAL VIEWS OF THE DRAWINGS

The invention will now be substantially described herein and with reference to the accompanying drawings in which.

DETAILED DESCRIPTION OF THE INVENTION

Due to the many versions of this combination tool, the best way of describing this invention is to firstly show and describe the very basic bare bones version and then how it works and then the various attachments, modifications and combinations of the tool.

Figure 1:
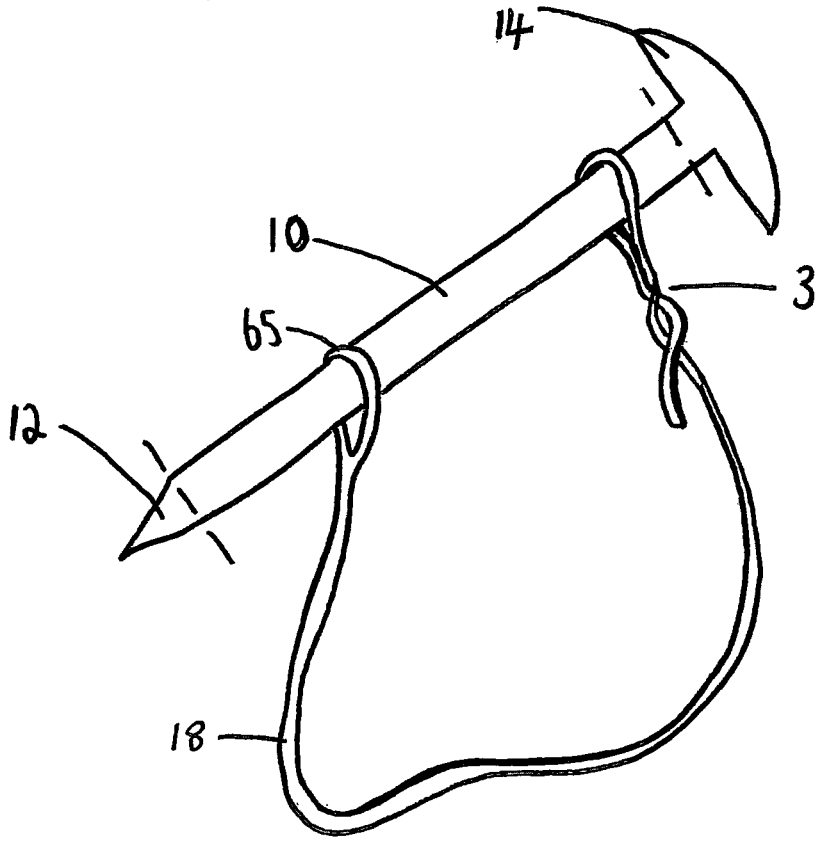
FIGS. 1 and 1A shows the invention in perspective; main body and rail strap
Figure 1A:
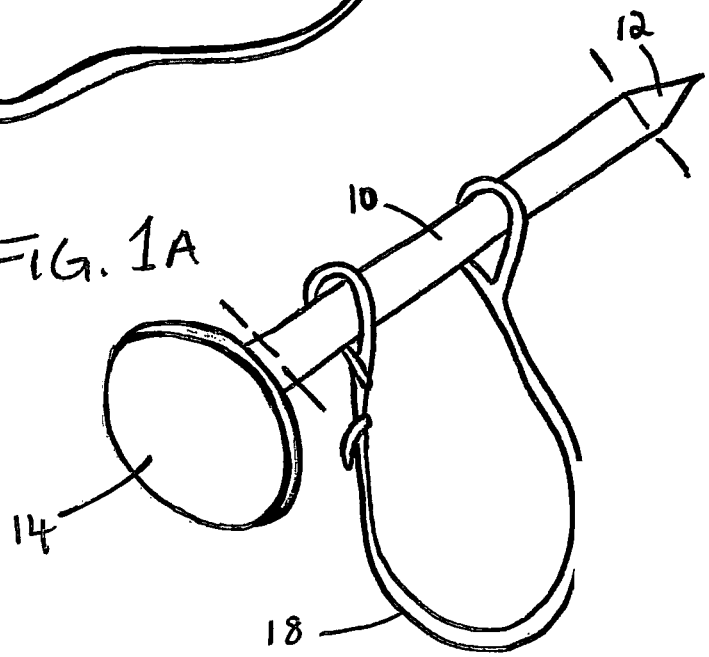
Figure 2:
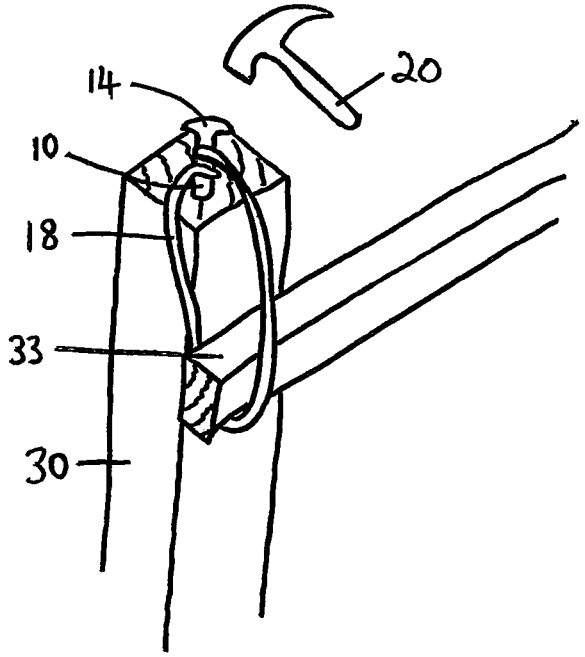
FIGS. 2 and 3 shows how the invention is used with a fence rail and post
Figure 3:
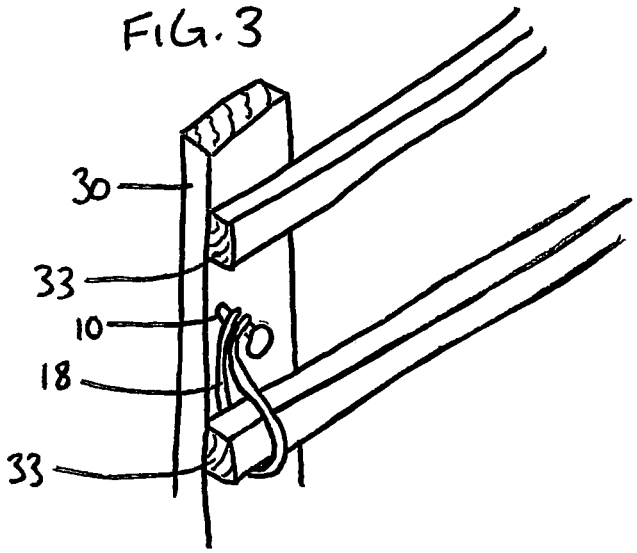

FIGS. 1 and 1A on page 1/19 show in perspective the invention comprising a main body 10 having a tip in the shape of a point 12 and a head 14 which is shown having a strap 18 tied to the main body 10 at both of its ends. This is the naked lady—the stripped down, no frills basic invention. The idea of the invention is illustrated in FIGS. 2 and 3 on page 2/19 where the tool is temporarily whacked into the fence post 30 and the strap 18 is wrapped around the fence rail 33 and then tightly secured back onto the main body 10 and therefore clamping the rail 33 in place against the post 30—allowing the workman to let the rail 33 go so that he can pick up the other end of the rail 33 and secure it to the other post 30. The tool can be attached to any part of the post 30 but usually it would be either on the top or on the clamp face above the rail for ease of use as shown.

Figure 4A:
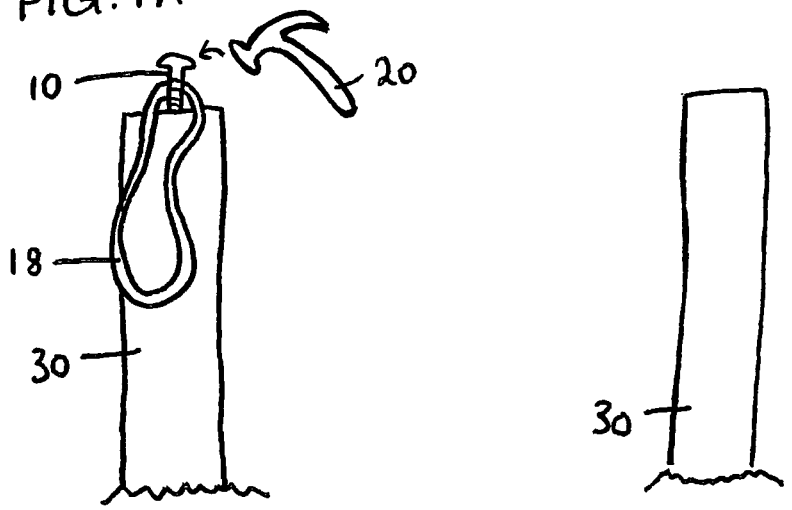
FIGS. 4A-E shows how the invention is used with a fence rail and post, in sequence
Figure 4B:
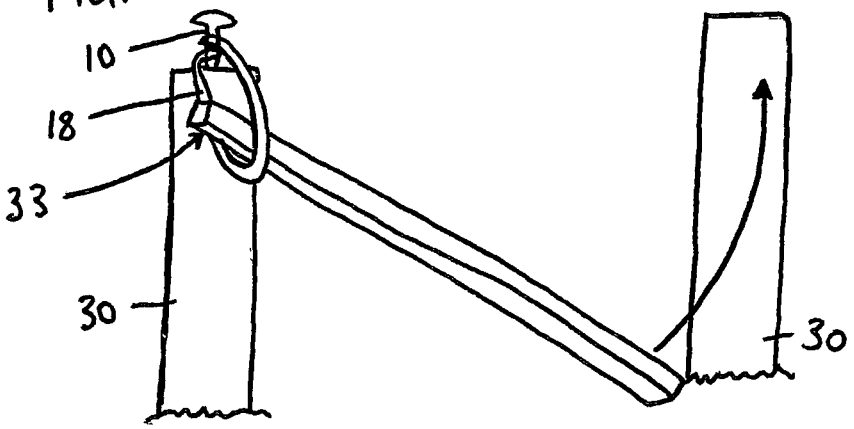
Figure 4C:
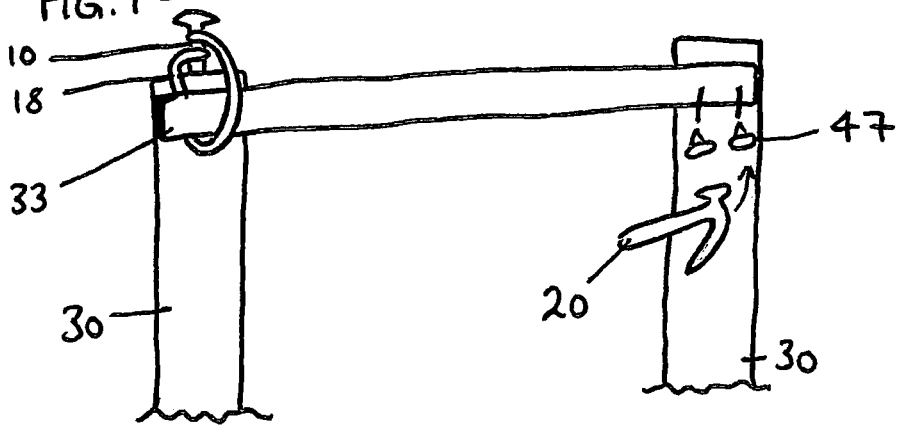
Figure 4D:
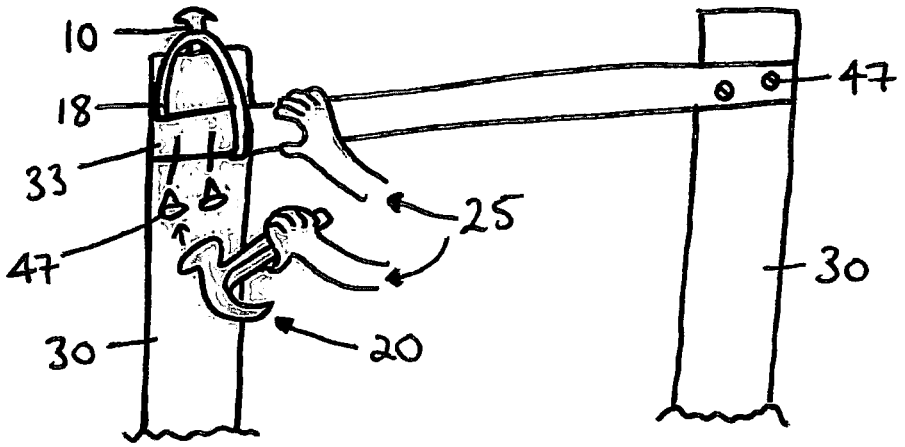
Figure 4E:
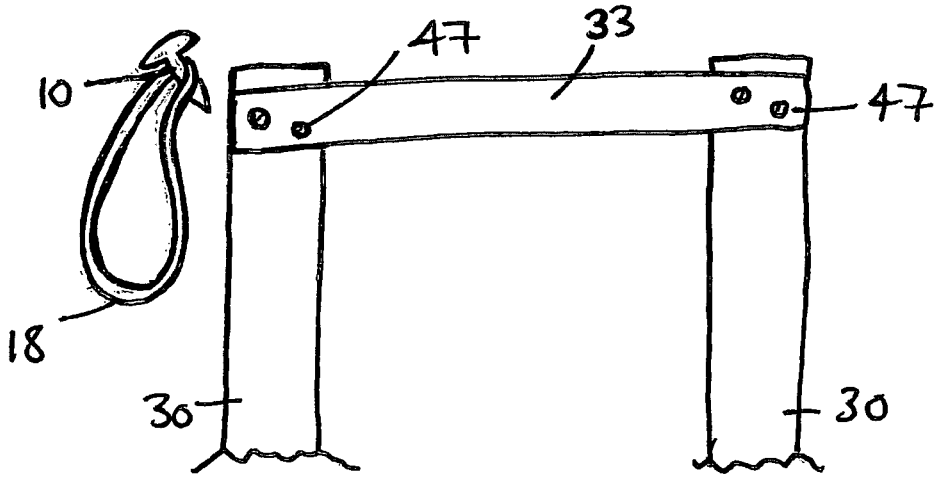

This is better explained by the illustrations 4A-E on pages 3/19 and 4/19. This sequence starts at FIG. 4A which shows two posts 30 spaced apart the length of the rail not shown. The tool 10 is temporarily secured to the left post 30 using the hammer 20. Next in FIG. 4B the two posts 30 are spaced apart with the tool 10 fixed to the post 30 with one end of the fence rail 33 put though the strap loop and supported by the strap 18 which is attached to the main body 10. The other end of the rail 33 is resting on the ground. FIG. 4C shows the unsupported end of the rail 33 now swung up off the ground to the other (right) post 30 and is being fixed to the post 30 by the hammer 20 via the nail 47 securing this end of the rail 33 to the post 30. FIG. 4D shows the rail 33 secured by nails 47 to the right post 30 and now the workman's hand 25 is back at and holding the left end of the rail 33 whilst the strap 18 is taken off the rail 33 and is left hanging loose (but still attached to the tool 10) over the side of the post 30 whilst the rail 33 is simultaneously secured by another nail 47. FIG. 4E shows the tool 10 is completely removed as the rail 33 is now securely fixed to posts 30 at both ends. Job Done. The workman then moves onto another rail section of the fence. I know this works because I've tested a prototype.

Figure 5A:
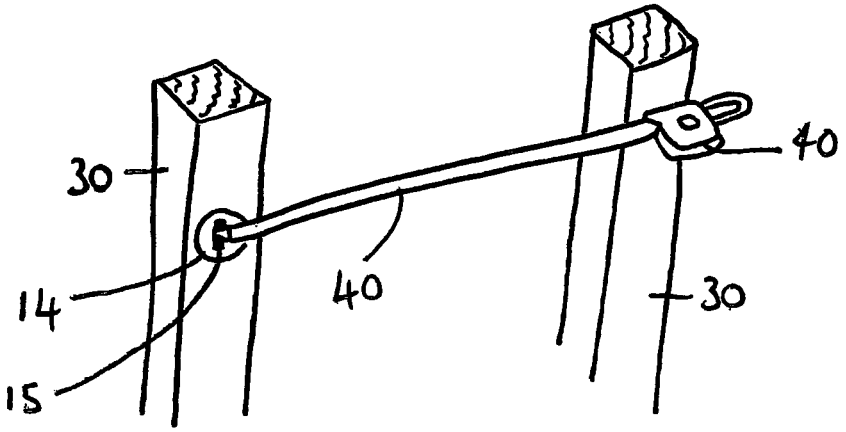
FIG. 5A-C illustrate how the invention can be used with a tape measure to help measure rail span between posts
Figure 5B:
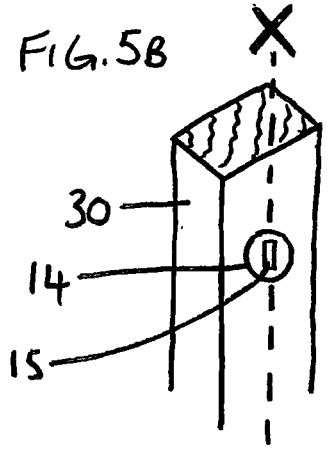
Figure 5C:
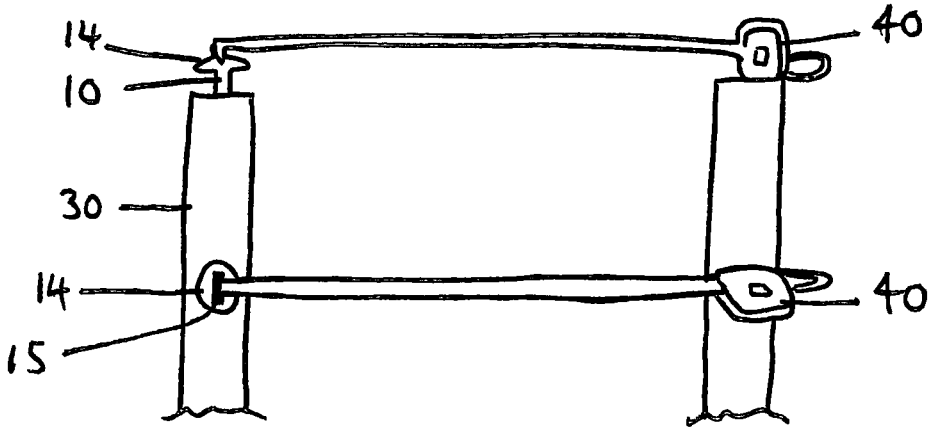

FIGS. 5A, 5B and 5C on page 5/19 show how the tool 10 is needed to hold the loose end of a tape measure 40 and used in combination with the tape measure to measure the distance between posts 30. The reason for this is that if one person is doing this job, the end of the tape measure needs to be secured to take measurements. Often the posts are not spaced precisely the same distance apart due to ground conditions, obstacles, accuracy of measurements etc and therefore rails may need to be cut to fit; but of course unless the gap between the posts is measured, one doesn't know how long the rail has to be. Using the slot 15 in the head of the tool 14 as an anchor for the end of the tape measure 40 is easier than trying to hook the end of the tape measure around a post etc where it usually falls off—which is annoying and wastes time. FIG. 5A shows two posts 30 spaced apart and the tool 10 pinned to left post 30. The tape measure 40 is drawn across the gap from the left post 30 to the right post and the measurement (centre of post to centre of post) is taken. The end of the tape measure 40 is anchored into the tool 10 by one of its attachments, slots or modified shafts—explained later. FIG. 5B is a close up sketch of how a modified head 14 of the tool 10 can be used to anchor the tape 40 and provide an accurate measurement down the face of the post as shown by the perforated line marked 'X' against the post 30. FIG. 5C illustrates how the tool 10 can be positioned on top the post 30 or on the clamp face and can still be used as an anchor point for the tape 40 through the modified head 14 having a retaining slot for the tape 40.

Figure 6A:
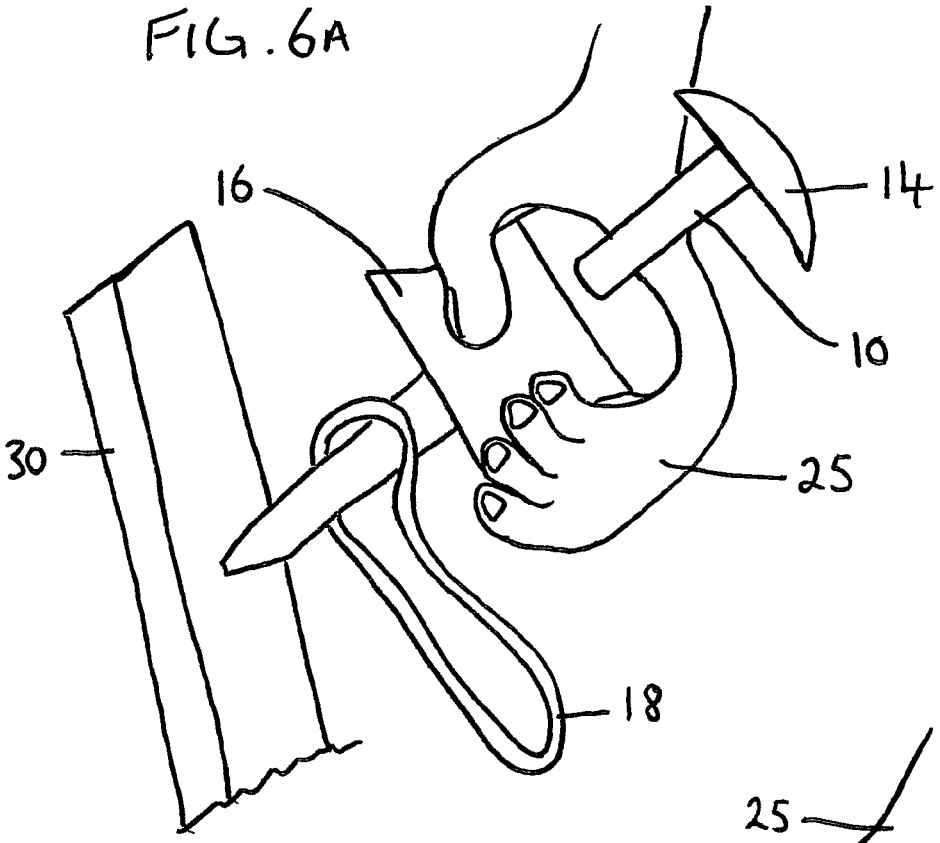
FIGS. 6A and 6B illustrates how the tool needs to be removed from the post by hand
Figure 6B:
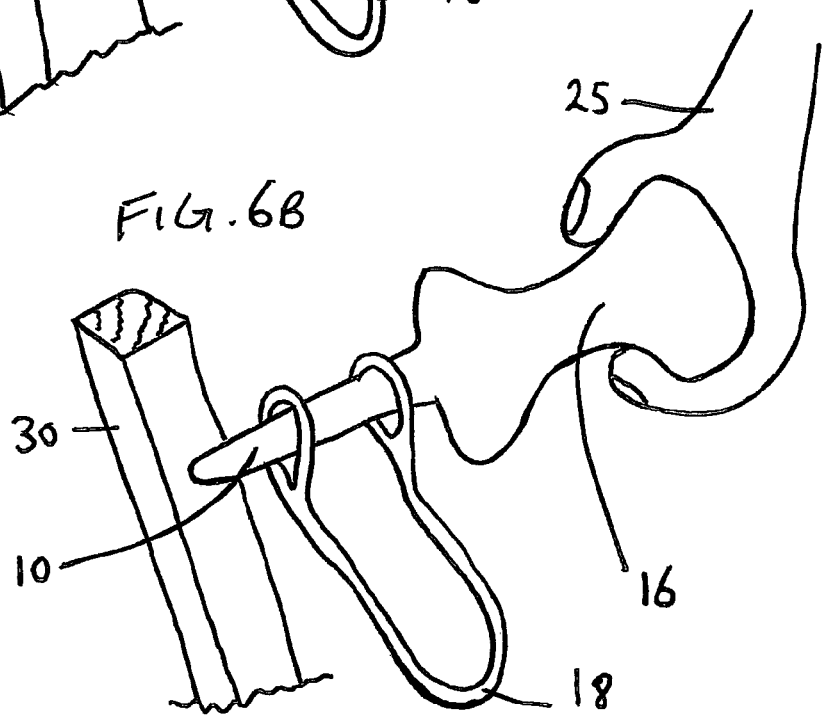

FIGS. 6A and 6B on page 6/19 illustrates how the tool 10 needs to be removed from the post 30 by hand 25 as it has been whacked into the post and secured through the tool's point at its tip, in order to provide the strength and resistance needed to hold the rail to the post via the strap. As the tip has been nailed in, the tool needs to be extracted or wriggled free, quickly and easily. I found that a gripping point or lug 16 about midway along the main body 10 would be useful to extract the tool from the timber as less effort was needed as the lug 16 would act like a handle and it was safer than trying to grasp the main body 10 where the head 14 would press against one's hand which may lead to injury. FIG. 6B also on page 6/19 shows the alternative version where the lug 16 is incorporated into the head 14 but the same principle applies.

Figure 7A:
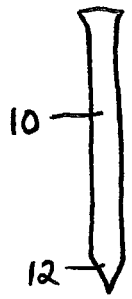
FIGS. 7A-T depicts a range of shafts that can form the main body
Figure 7B:
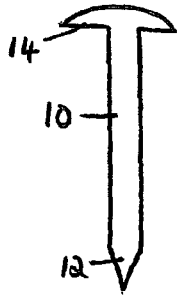
Figure 7C:
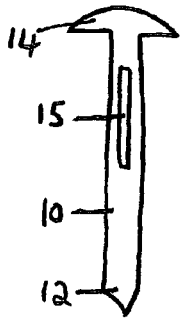
Figure 7D:
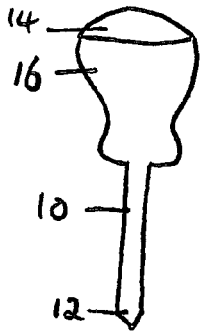
Figure 7E:
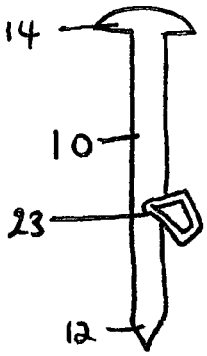
Figure 7F:
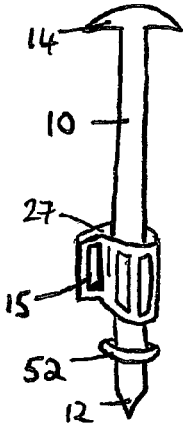
Figure 7G:
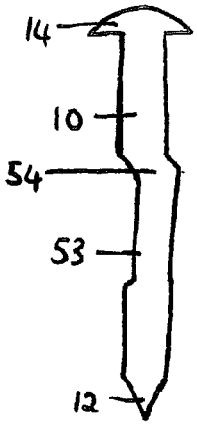
Figure 7H:
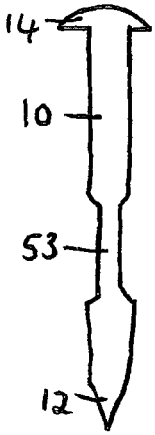
Figure 7I:
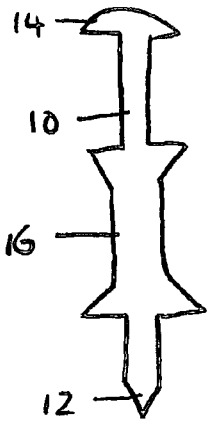
Figure 7J:
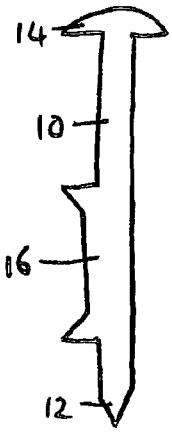
Figure 7K:
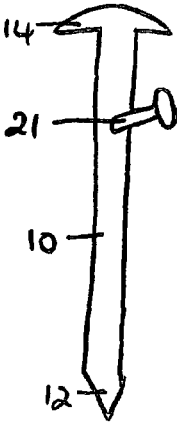
Figure 7L:
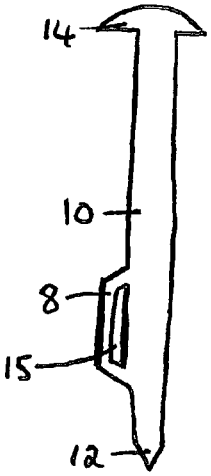
Figure 7M:
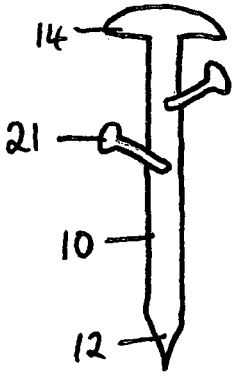
Figure 7N:
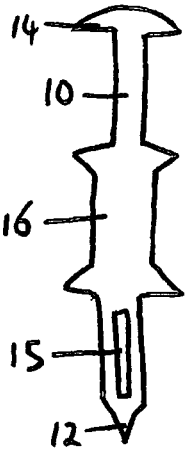
Figure 7O:
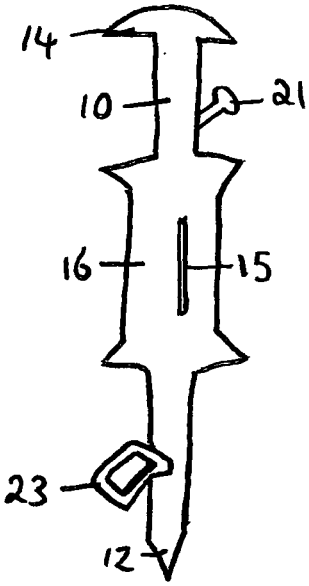
Figure 7P:
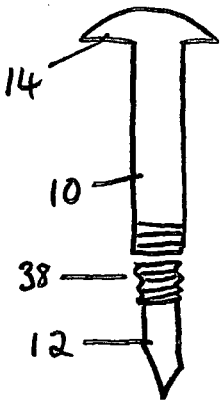
Figure 7Q:
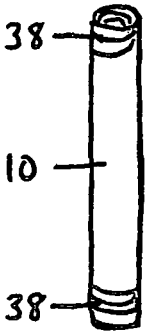
Figure 7R:
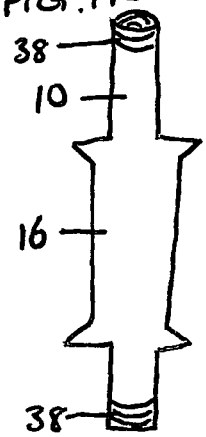
Figure 7S:
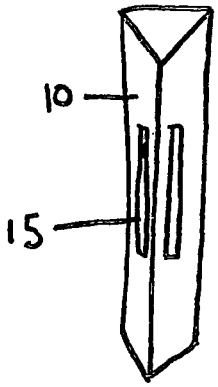
Figure 7T:
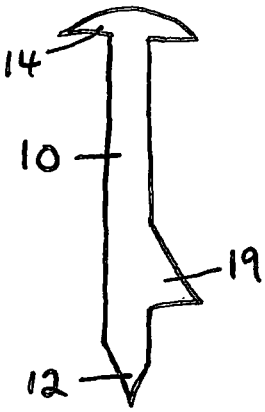

FIGS. 7A through to T on pages 7/19 and 8/19 show a range of different shafts that could be used as the main body 10. The reason for the range of shafts is that there could be a large range of applications the tool could be used for outside of fencing such as hoisting up and retaining floor joists or lintels and the different shafts allow for different ways and types of straps to be used: small versions of the tool and large versions, for lighter and heavier fencing and that the shaft could be one piece of/or several pieces to make the tool more interchangeable with its parts. Also the different shafts could be manufactured in different ways allowing a cheap version of the product to be produced and a premium version for different markets. FIG. 7A is the basic singular shaft with a pointed tip and a head which is a lip running around and extended from but incorporated into the body—used similarly to a 'punch' for piercing the timber. FIG. 7B is the same as 7A but with a head 14 incorporated like a nail shape. FIG. 7C as in 7B but incorporating a hole or slot 15 to receive a strap. FIG. 7D shows the shaft having a head 14 with a thumb lug 16 incorporated. The tool could be cast as one piece so that no attachments are needed but this would limit the versatility of the tool. FIG. 7E having an eyed hook 23 to receive a strap attachment. FIG. 7F having a free spinning strap attachment 27 retained on the body 10 by a circular 'STOP' piece 52 at the lower end of the shaft 10. FIG. 7G shows a shaft that is elongated and having at least one bend 54 in the shaft with a portion of the shaft having a recessed area 53 for the purpose of receiving and retaining the end of a tape measure not shown and/or to be used with attachments not shown to retain them in place without welding or other fixing methods. In this Figure, there is one single sided recess. FIG. 7H shows a double recessed version where the recesses 53 are symmetrical. FIG. 7I shows a 'double' thumb lug 16 incorporated where the lugs 16 are on both sides or circulate/encapsulate all sides of the body 10. FIG. 7J shows a shaft 10 with a single sided thumb lug 16. FIG. 7K shows a shaft 10 having a 'prong' 21 incorporated for the purpose of receiving and retaining a strap hole. There may be more than one prong to allow the strap to be wound tightly around the shaft and retained in more than one place as shown in 7M on page 8/19. FIG. 7L shows a version where the shaft has a protrusion or extended portion 8 with an aperture 15 to receive a strap or strap fastening. FIG. 7N shows the shaft 10 with a double thumb lug 16 and a hole 15 for a strap not shown to illustrate that the shaft may incorporate one, all or a combination of holes, hooks, lugs, prongs, heads, bends, recesses, lips, swivel attachments, Stops and so on in able to produce a vast range of combinations and uses of the tool as shown in FIG. 7O where the shaft 10 has a double thumb lug 16, an eyed hook 23, head 14, pointed tip 12, prong 21, and a slot 15. FIG. 7P shows the shaft incorporating a head but this time the shaft is made of two pieces that are screwed together using male and female screw thread connecting parts 38: the pointed tip and the main shaft. The reason for the separate screw on tip is that as the tip wears down through use of the tool, the tip can be replaced without having to buy a whole new tool and this idea is carried on through the invention where the shaft is a basic long elongated body 10 having a screw thread 38 at each end as shown in FIG. 7Q so that all the other parts of the tool can be attached and combined and interchangeable to suit the workman and how he wishes to use the tool for different applications. FIG. 7R shows the shaft having a screw thread 38 at each end and a thumb lug 16 incorporated in the middle. FIG. 7S shows the shaft formed in a triangular shape as opposed to a cylindrical shaft and having two slots 15 to pass the strap through. FIG. 7T shows the main body having a pointed tip with a fin 19 at the lower end of the shaft to prevent the tool being pulled downwards by the rail due to the weight of the rail suspended being suspended from the tool; said fin 19 acts as another kind of Stop as explained in FIG. 17, later.

Figure 8:
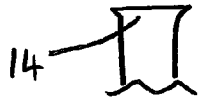
FIGS. 8 and 8A-J depicts a range of different heads that can attach to the shaft
Figure 8A:
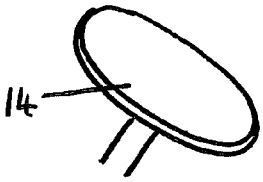
Figure 8B:
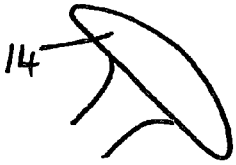
Figure 8C:
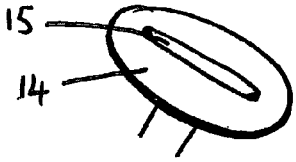
Figure 8D:
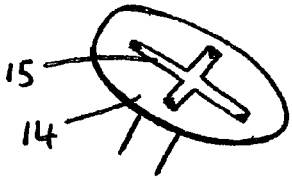
Figure 8E:
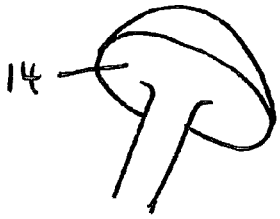
Figure 8F:
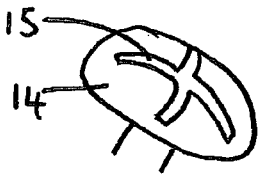
Figure 8G:
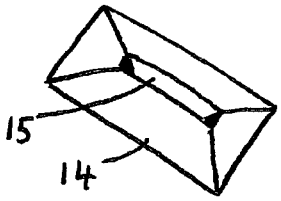
Figure 8H:
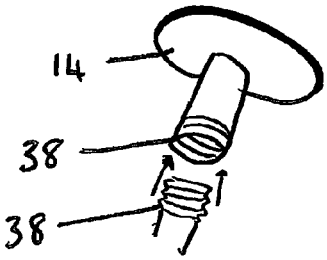
Figure 8I:
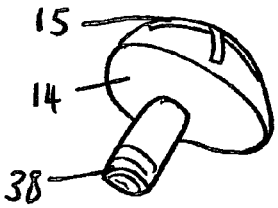
Figure 8J:
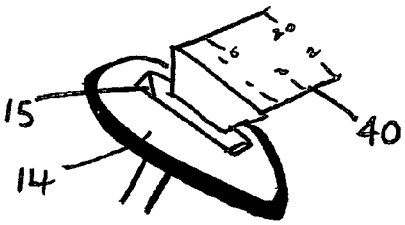

FIGS. 8 and 8A-J on page 9/19 illustrate the different types of heads 14 that can be incorporated or attached to the body. FIG. 8A shows the basic flat oval nail like head. The purpose of having a head on the body is for two reasons: 1. to receive the strike of a hammer to push the tool into the timber and 2. to retain the wire or strap from falling off the body. FIG. 8 shows the end of the shaft where there is a lip around the circumference of the upper end for this purpose, but this is not sufficient to stop the wire escaping and so a larger head is needed. FIG. 8B shows the nail like head as in 8A but concaved so that the hammer can strike accurately from vastly more orbiting positions. FIG. 8C shows the same head as in 8B but with a recessed channel or slot 15 to receive the end of a tape measure. This channel may be formed as a singular slot or double slot in a cross like shape as shown in FIG. 8F to allow the tape to be fastened and drawn out at several angles whilst the tool is fixed into the post. FIG. 8E is a view of the head from underneath showing the underneath is generally flat. FIG. 8G shows a rectangular head with a top slot to receive the tape measure as illustrated in FIG. 8J. FIG. 8H shows the flat oval head having a screw thread underneath and illustrates how it can be as a separate attachment to the main shaft so that the user could have a choice of different heads. FIG. 8I is the concave version. The head may also spin or turn freely on a pivot to the main body (not shown) to allow the tape measure to be swiveled in other directions whilst remaining attached to the head.

Figure 9A:
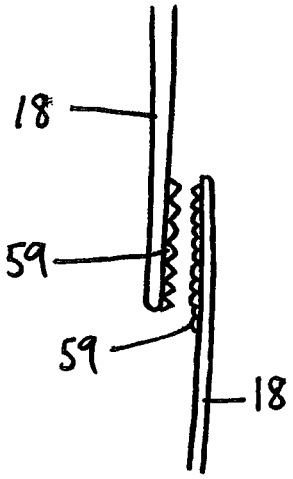
FIGS. 9A-G illustrates different types of straps and strap attachment ends
Figure 9B:
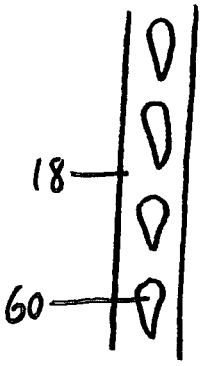
Figure 9C:
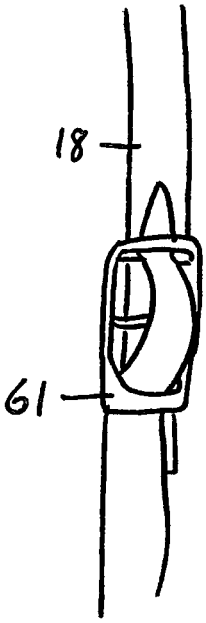
Figure 9D:
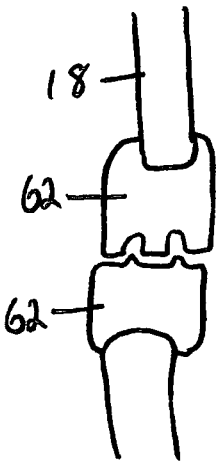
Figure 9E:
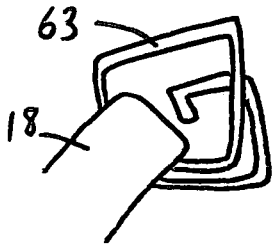
Figure 9F:
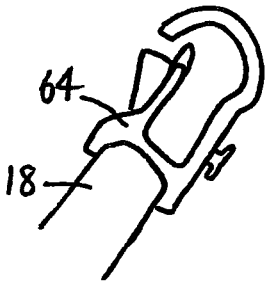
Figure 9G:
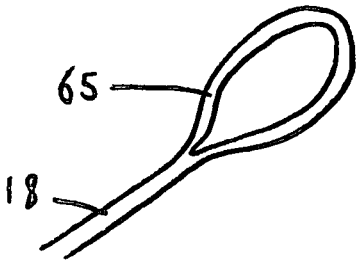

There are a range of different types of straps and strap attachments that are used with the tool which make the tool easier to use or better for different applications such as tools using wire, rubber, nylon, string or metal straps. The usefulness of these different types of straps varies: with a wire strap, the rail is held tightly with not a great deal of room for movement due to wire being much more tightly wound. This would be useful on metal posts. Using a lanyard strap would be slightly looser and would allow the rail a degree of movement for adjusting the other end of it before being fixed which means the rail can be accurately fixed. A rubber strap would be able to be stretched to fit around larger thicknesses and dimensions of timber or a shorter strap could be used that would stretch further. There could also be a strap with Velcro like ties so that no fixing catch is needed and the strap can be wrapped around the timber and the ends simply tied together to speed up the process, if accuracy is not the highest priority for example in farm/stock fencing. For these different types of strap materials, different catches or fixings will be needed to attach them to the main body of the invention, hence the incorporation or attachment of prongs, holes, eyed hooks, hooks and clips etc as explained in FIG. 7 earlier. FIGS. 9A-G on page 10/19 illustrate the different straps used. FIG. 9A shows a strap with Velcro 59 fastening on each end. FIG. 9B shows a lanyard with a run of holes 60 down the middle. This strap 18 allows the holes 60 to fit over the prongs 21 that protrude from the main body 10 not shown so that if the strap 18 needs to be tightened, it is just pushed over the next hole 60 along like a belt and buckle. FIG. 9C shows a buckled version. FIG. 9D shows a strap 18 with a luggage type clip fastening 62 which could be used in conjunction with the buckle version. FIG. 9E shows a wire clip version 63 like a key ring fastening where the strap 18 is pushed around the wire 63 to be trapped in the middle to prevent it becoming free of the fastening. FIG. 9F shows an opening/closing hook 64. FIG. 9G shows a strap 18 with a hoop 65 at each end which is a strap where the hoop simply fits over the head of the tool so that it is quicker to hang over and take off the main body but is best used in conjunction with an adjustable strap not shown. Any of these fastening types can be combined on straps and used together to attach the strap to the main body by means previously explained and now illustrated in FIGS. 10A-F on page 11/19.

Figure 10A:
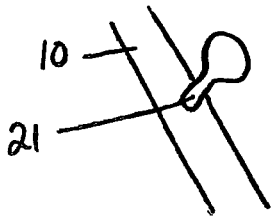
FIGS. 10A-F show a range of strap attachments to the main body
Figure 10B:
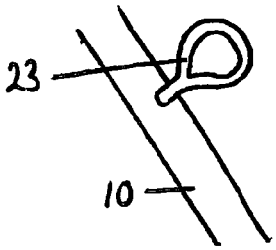
Figure 10C:
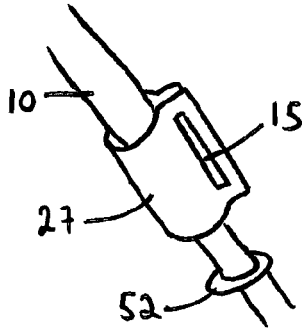
Figure 10D:
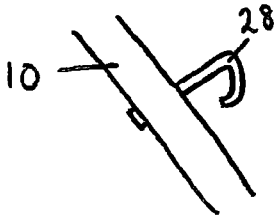
Figure 10E:
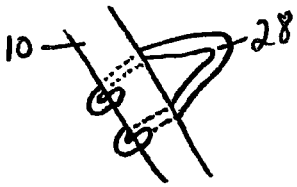
Figure 10F:
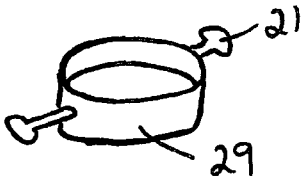

FIGS. 10A-F on page 11/19 show different means of attaching the strap 18 to the main body 10 as aforementioned. FIG. 10A shows a prong 21 protruding from the main shaft that receives the holed or slotted strap not shown. FIG. 10B shows an eyed hook 23. FIG. 10C shows another attachment known as a swivel attachment 27 that spins freely around the main shaft 10 and which is retained by the circular STOP clip 52 as mentioned earlier. This allows the strap to be pulled as close as possible to the nearest edge of a piece of timber for a tighter hold. FIG. 10D shows a hook 28. FIG. 10E shows a 'U' shape hook 28 that is fastened by legs through holes in the shaft said legs which are then bent around the profile of the shaft to retain the hook without the need for screwing/welding it to the shaft. FIG. 10F shows another separate freely rotating attachment 29 which is a circular ring having one or more prongs 21 attached to it so that the prongs can be removed from the tool if not needed; depending on which strap is used. The point of all these different bodies, heads, straps etc is to make the tool as universal as possible for as many different types of fencing and rails as possible. Some applications need the strap to freely spin to secure it at the point closest to the clamp face and, allowing the strap to move, means it can be tightened where one's hand cannot reach to secure it at awkward angles.

Figure 11A:
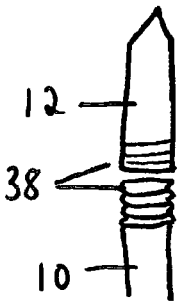
FIGS. 11A-C shows different types of points and couplings at the lower end/tip of the body
Figure 11B:
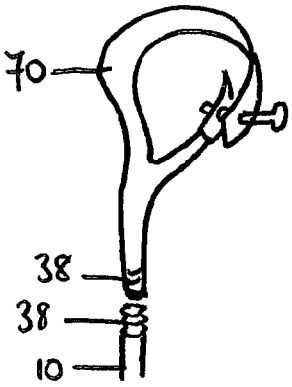
Figure 11C:
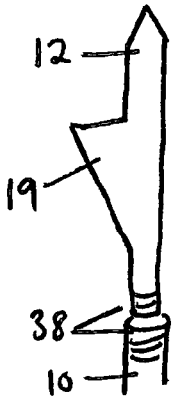
Figure 12A:
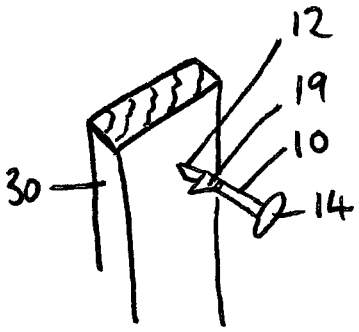
FIGS. 12A and 12B shows how these different couplings interact with different posts
Figure 12B:
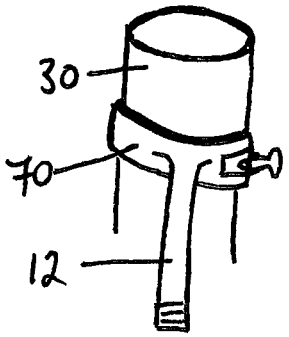

FIGS. 11A to C on page 11/19 show three alternative 'tip' attachments for the tool that are interchangeable and which screw or clip onto the lower portion of the main body. FIG. 11A shows the pointed tip 12 and FIG. 11B a grab or claw attachment 70 with its own tightening means for fastening around circular posts. FIG. 11C shows the tip 12 with a slanted point and a fin 19. Attachments as illustrated in FIGS. 12A and 12B on page 12/19 where FIG. 12A shows the pointed tip and fin penetrating a solid wooden post and 12B showing the claw attachment 70 clamped around a circular post 30.

Figure 13A:
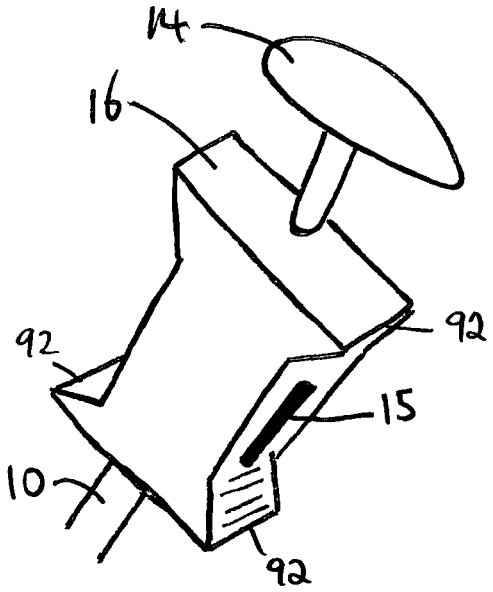
FIGS. 13A-B shows two different types of thumb lug incorporated into the main body
Figure 13B:
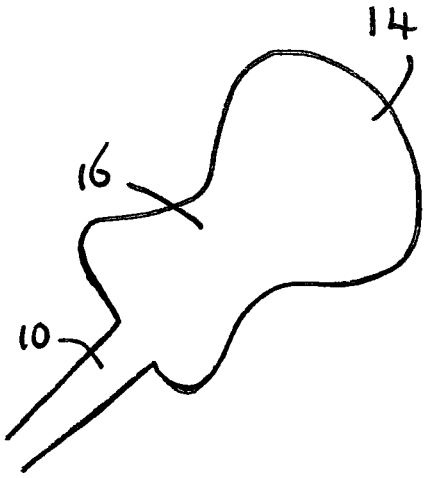
Figure 14A:
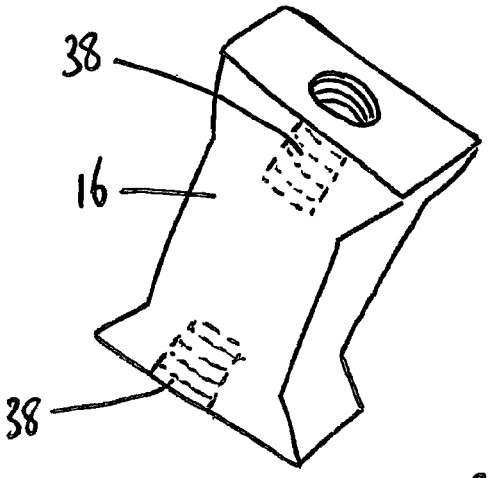
FIG. 14A-C shows how the thumb lug could be fitted as a separate attachment
Figure 14B:
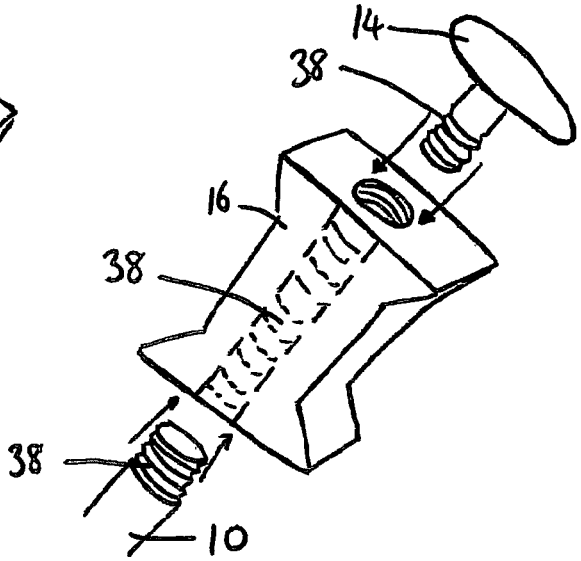
Figure 14C:
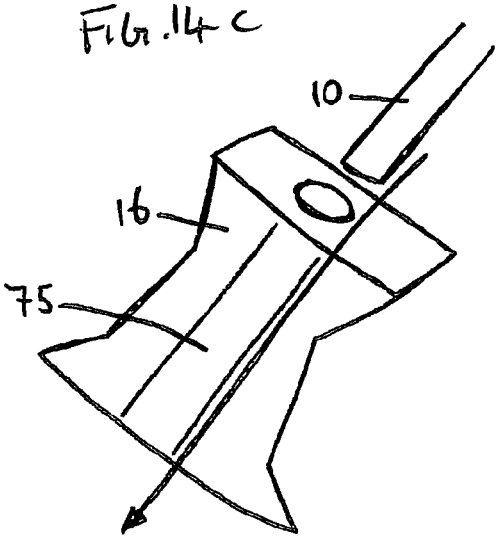
Figure 15A:
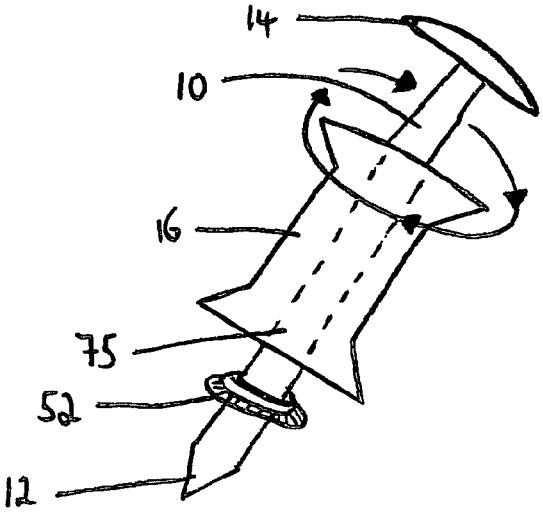
FIGS. 15A-D show a part known as a STOP and how it is used with the tool FIGS. 16A-E to illustrates how the different shafts, points, heads and thumb lugs may be interchangeable to customize the tool for various applications
Figure 15B:
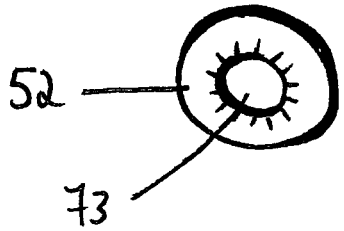
Figure 15C:
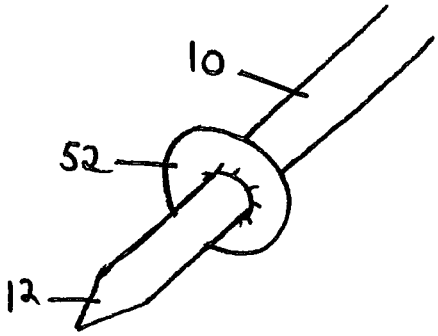
Figure 15D:
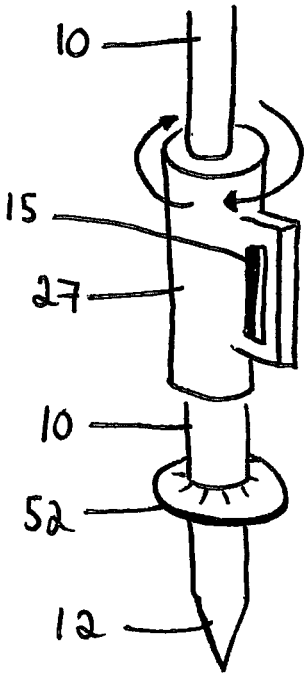
Figure 16A:
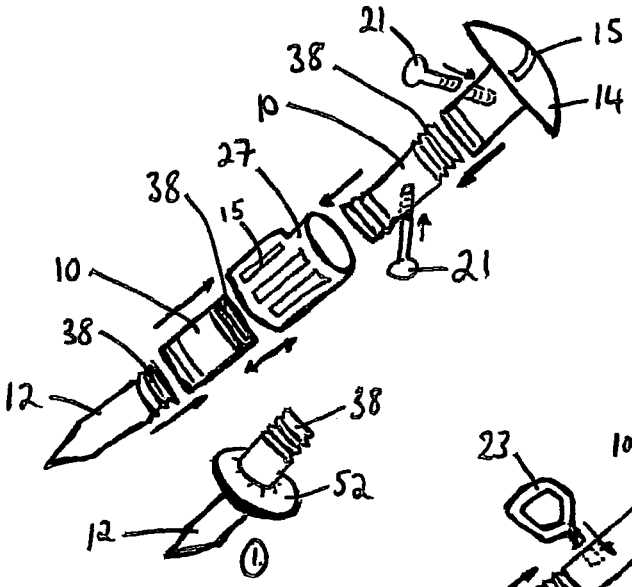
Figure 16B:
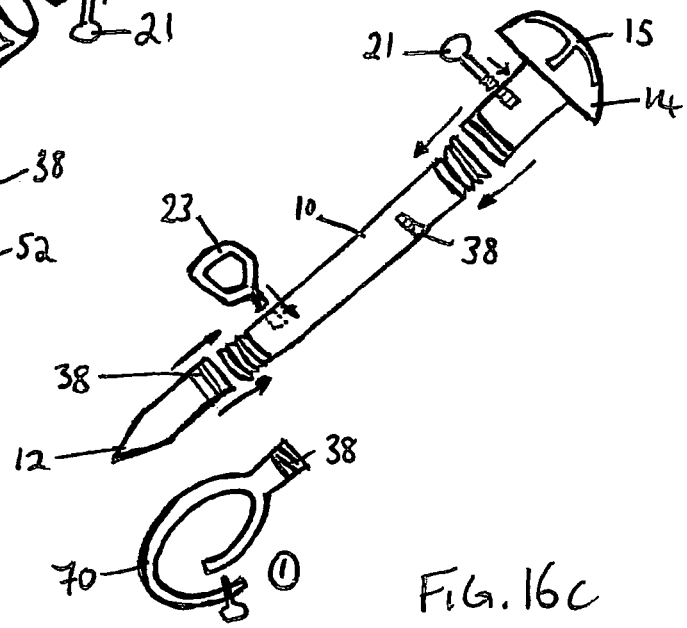
Figure 16C:
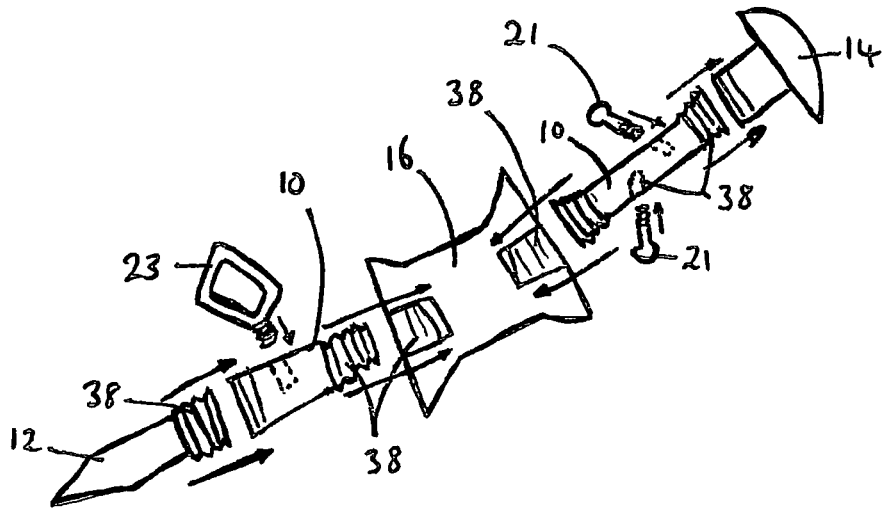
Figure 16D:
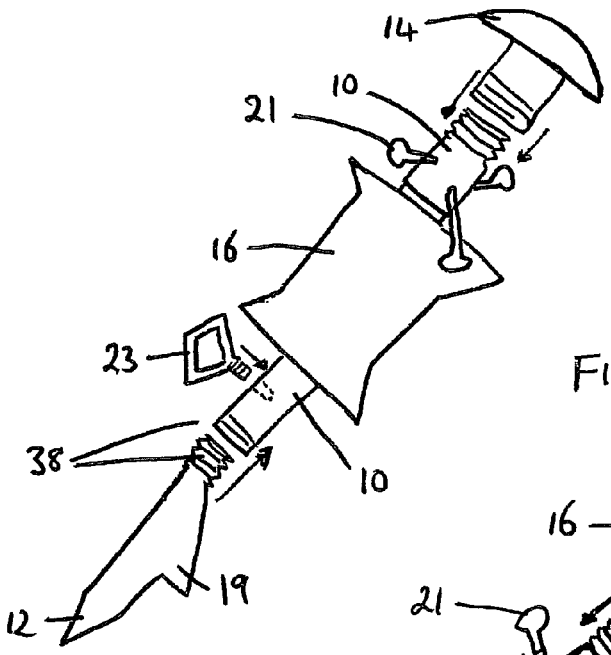
Figure 16E:
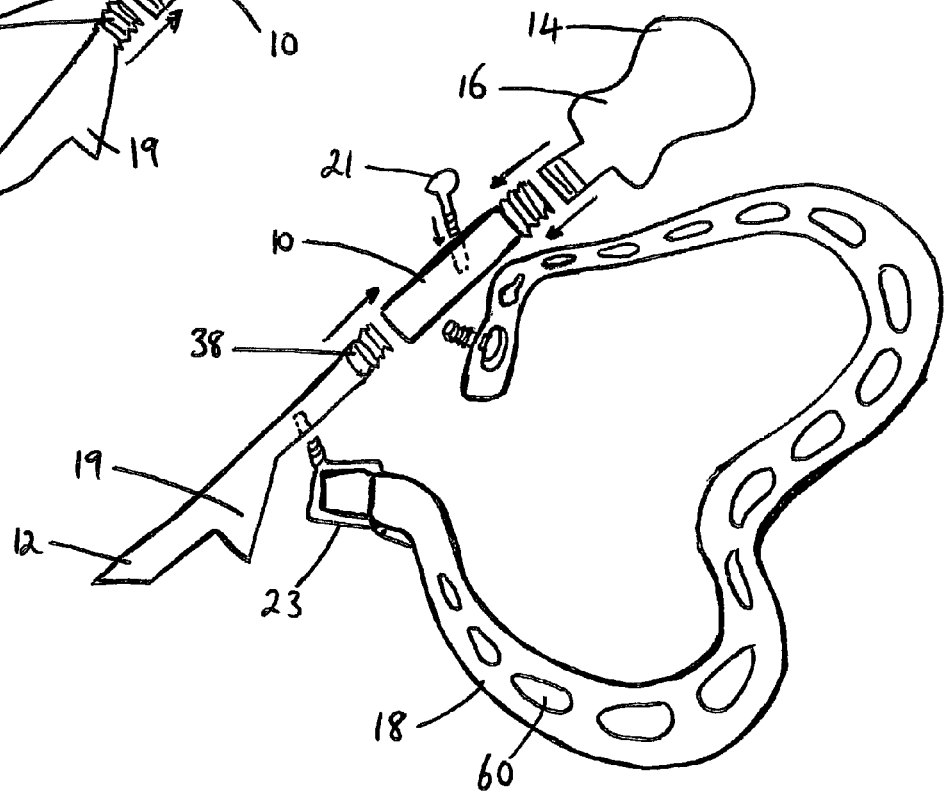

FIGS. 13A and 13B at the bottom of page 12/19 show two different types of thumb lug 16 incorporated into the main body 10. FIG. 13A shows the rectangular block version having spurs 92 at the top and bottom or a recessed mid portion so that the user can get a good finger grip on the lug 16 to twist the tool out of the timber. The recessed angular portions could also retain a tape measure if necessary. The lug 16 may have at least one slot 15 for this purpose. The lug in FIG. 13B has more of a rounded off curvature to it and is positioned directly below or incorporated into the head 14. This version is for larger tools where the user needs more force to extract the tip; as the lug is shaped to fit into the users palm so it can be clutched more easily. Either version can be added as an attachment to the main body by use of screw threads or clips/push fittings as shown in FIGS. 14A-C on page 13/19. FIG. 14A shows the thumb lug 16 having two threads 38: one at each end of the body of the lug 16 to enable it to screw into other parts or the main shaft as illustrated in FIG. 14B. The thumb lug is not always needed with very light timber; in these applications the tool is acting as a clamp and extra hand to releasably secure rails that need to be adjoined and not necessarily whacked into the timber as hard as possible where it would be very difficult to extract it without great force, which then partially defeats the point of the quickness and easy of use of the tool. FIG. 14B illustrates how the thread could go all the way through the thumb body for a stronger join of the parts and FIG. 14C shows how the thumb lug body could have a hollowed channel 75 so that it could just slide over the shaft and spin freely around the shaft if required. It would be retained on the shaft by the circular STOP piece 52 depicted in FIG. 15A also on page 13/19. The Stop 52 is either incorporated into the main body as shown or again as an individual attachment to retain strap fixings, thumb lug or any independent freely moving part that is not secured permanently to the body. FIGS. 15B-D on page 14/19 highlight this in more detail where FIG. 15B shows the Stop 52 as a ring with a hole in the middle to fit over the main body as shown in FIG. 15C. FIG. 15D illustrates how the Stop 52 is positioned towards the lower end of the body 10 so that the separate swivel attachment 27 can spin freely around the body but is retained on the body 10 by the Stop 52. This is so the attachments don't get damaged near the tip when the tool is hammered into the post and so that the tip can also be interchangeable without the rest of the assembly falling apart.

FIGS. 16A-E on pages 15/19 and 16/19 illustrate how the many different shafts, points, heads, thumb lugs and other parts may be interchangeable to customize the tool for various applications. These show how the main shaft may also have mini threaded holes to receive the prongs or hooks and so on and an overview of how the tool fits together if manufactured in different parts so that the user can put them together however theay wish if the tool was supplied in kits.

Figure 17A:
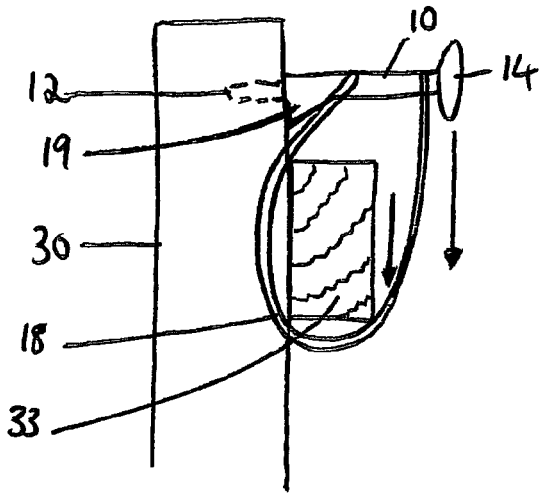
FIGS. 17A-C show how the Fin works
Figure 17B:
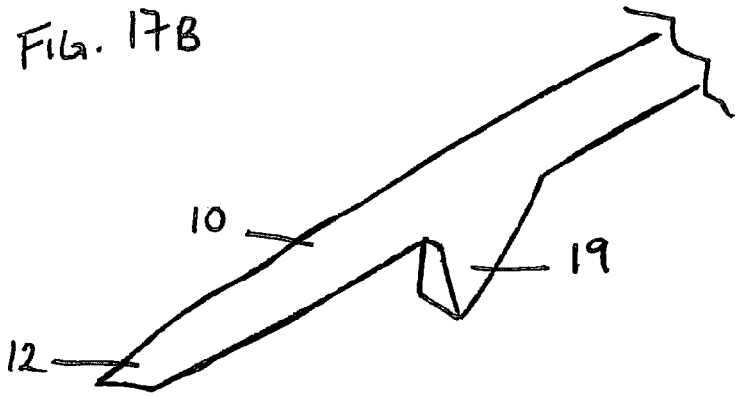
Figure 17C:
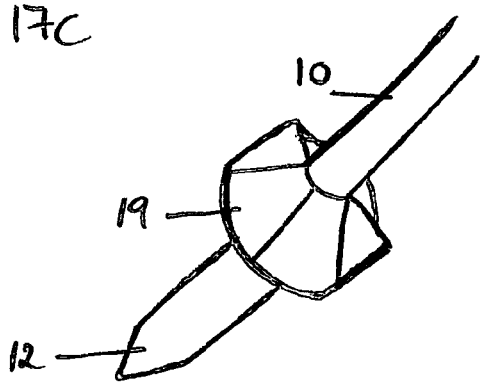

FIGS. 17A-C on page 17/19 demonstrate how the Fin 19 works. FIG. 17A illustrates how the rail 33 has been suspended against the post 30 by the strap 18 hanging from the main body 10 that is fixed to the post 30 through the tip 12 that has pierced the timber post. There are two arrows illustrating the downward pull of the rail within the strap which simultaneously pulls a downward gravitational force on the main body 10. Without the Fin 19, the tool would be pulled out from the timber by the force unless it is hammered in very well. The point of this is that the tool is only lightly hammered in so that the tool can be quickly released/extracted by the user. What the Fin does is provide a Bump Stop for the body against the timber and counteracts the downward pull allowing heavy rails to be suspended by a lightly attached tool which is quick to remove. The fin can either be positioned on only one side of the body or extend from two or more sides as shown in FIGS. 17B and 17C on page 17/19.

Figure 18A:
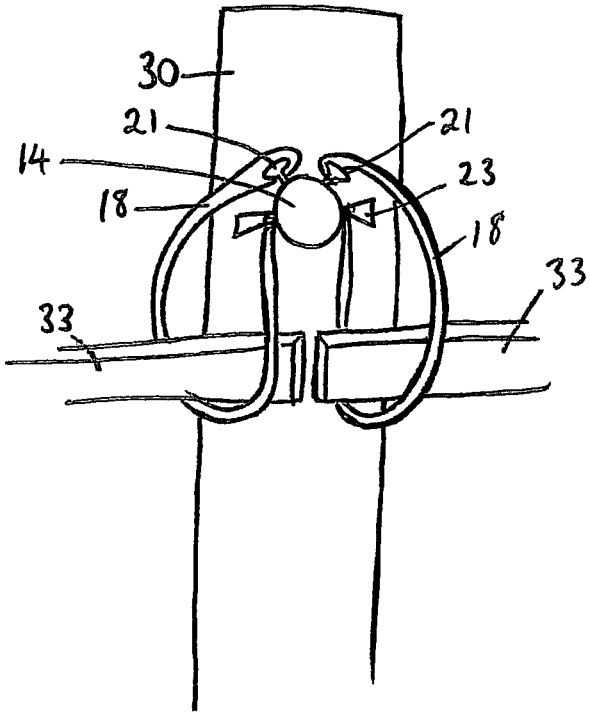
FIG. 18A illustrates how a double strap version with twin eyed hooks could be used to retain two or more rails at once.
Figure 18B:
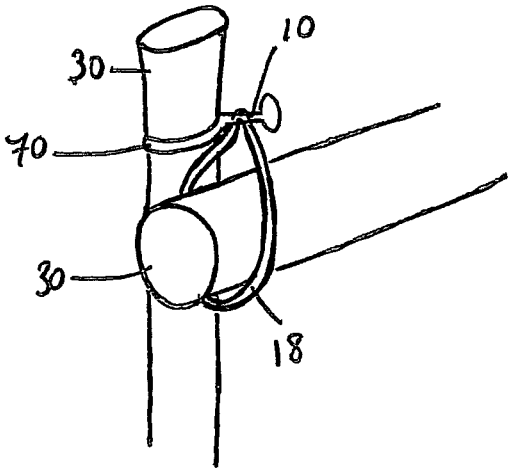
FIG. 18B illustrates how the invention can be used with circular posts and rails

FIGS. 18A and 18B on page 18/19 illustrates how the tool in one of its combinations can be set up to retain two rails against one post so that the user doesn't have to keep moving the tool. This combination shows the tool 10 from the front where the main body has one eyed hook 23 and one prong 21 on each side of the shaft and two straps 18 so that each side of the tool can retain each rail 33 either side of it whilst staying in one position on the post 30. FIG. 18B shows again how the grab attachment 70 can be used against circular posts.

Figure 19A:
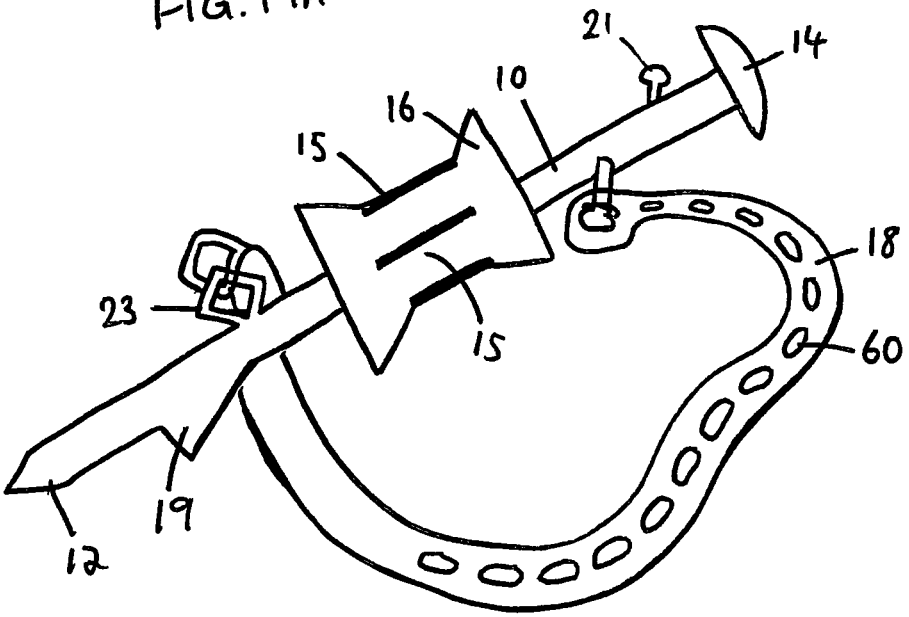
FIGS. 19A and 19B show two preferred fully constructed combinations of the tool.
Figure 19B:
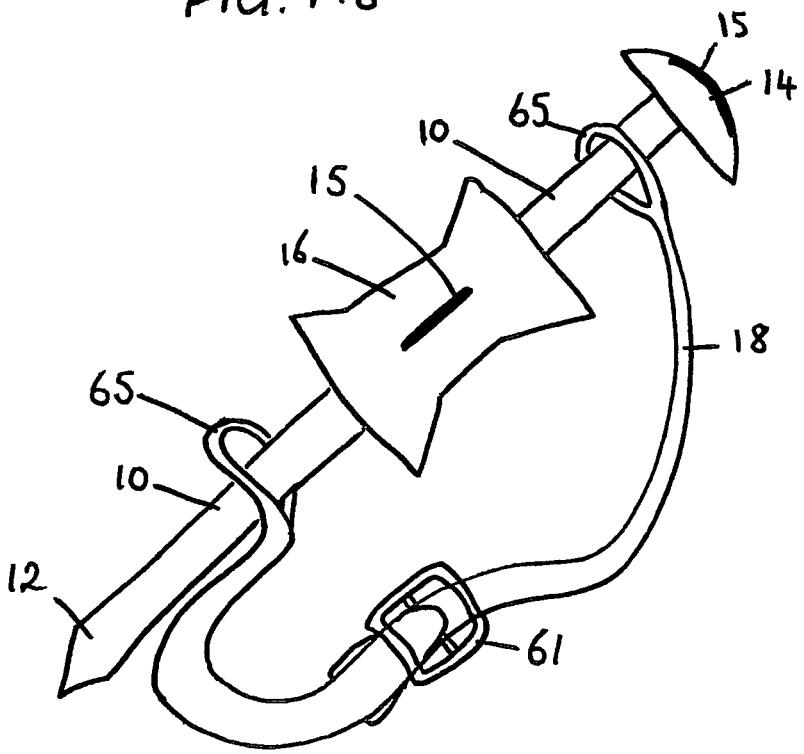

FIGS. 19A-B shows two preferred combinations of the tool to suit most applications. FIG. 19A on page 19/19 shows the fully constructed version having a main body 10 comprising a head 14, a pointed tip 12, a fin 19, two prongs 21 spaced opposite side of the body 10 and eyed hook 23 and thumb lug 16 with 3 slots 15 to receive a tape measure and a strap 18 with holes 60 attached to the main body by the strap clasp. This is the best combination for putting up wooden rails with wooden posts and a simplified version of it is depicted in FIG. 19B without the fin, prongs and hook where the strap just fits over the head and tip and is adjustable in the middle.

The tool may be used for other applications within construction such as retaining floor joists or lintels. Where one is working alone, these types of materials are usually quite lengthy and difficult to install without an extra pair of hands which is what this tool provides. These different materials are different shapes and weights which is where different strap types would come into play.

The invention claimed is:

1. A fencing rail fixing tool for supporting a fence rail during fixing comprising an elongate body and a strap, the elongate body comprising a pointed tip at a first end for piercing a fence post and an enlarged head at a second end for retaining the strap on the elongate body, a lug or fin is incorporated on the body between the first end and the second end and has a slot or aperture therein receiving the strap, wherein the lug or fin acts as a stop to limit insertion of the tip into the fence post and acts to reduce, prevent or limit sagging of the tool under the weight of the supported rail.

2. A fencing rail fixing tool for supporting a fence rail during fixing comprising an elongate body and a strap, the elongate body comprising a pointed tip at a first end for piercing a fence post and an enlarged head at a second end for retaining the strap on the elongate body, a lug or fin is incorporated on the body between the ends to act as a stop to limit insertion of the tip into the fence post and acts to reduce, prevent or limit sagging of the tool under the weight of the supported rail; at least one hole, slot or aperture receiving the strap or means to attach the strap.

3. A fencing rail fixing tool for supporting a fence rail during fixing comprising an elongate body and a strap, the elongate body comprising a pointed tip at a first end for piercing a fence post and an enlarged head at a second end for retaining the strap on the elongate body, a lug or fin is incorporated on the body between the ends to act as a stop to limit insertion of the tip into the fence post and acts to reduce, prevent or limit sagging of the tool under the weight of the supported rail; a cylindrical shaft portion that receives a separate part that fits around the shaft rotates freely of the shaft said separate part having at least one hole, slot or prong receiving a portion of the strap.

4. A fencing rail fixing tool as claimed in any preceding claim wherein the elongate body and head are cast as a single piece.

5. A fencing rail fixing tool as claimed in any preceding claim wherein the elongate body, head and tip are cast as a single piece.

6. A fencing rail fixing tool as claimed in any preceding claim wherein the elongate body and any of its parts are cast as a single piece.

7. A fencing rail fixing tool as claimed in any preceding claim wherein the elongate body comprises two or more separate connectable parts each of said connectable parts having one or more of either a threaded male and/or female type coupling means.

8. A fencing rail fixing tool as claimed in any preceding claim wherein said body or any of said connectable body parts has at least one hole, slot or aperture to receive a strap or means to attach the strap.

9. A fencing rail fixing tool as claimed in any preceding claim wherein said lug is a separate connectable part and has at least one means of connecting to the body parts by way of one or more threaded holes or a male to female coupling incorporated into the lug.

10. A fencing rail fixing tool as claimed in any preceding claim wherein any of the body parts incorporates or has means to receive at least one thumb lug.

11. A fencing rail fixing tool as claimed in any preceding claim wherein any of the body parts incorporates or has means to receive, connect and/or house at least one prong.

12. A fencing rail fixing tool as claimed in any preceding claim wherein any of the body parts incorporates or has means to receive, connect and/or house at least one hook.

13. A fencing rail fixing tool as claimed in any preceding claim wherein any of the body parts incorporates or has means to receive, connect and/or house at least one eyed hook.

14. A fencing rail fixing tool as claimed in any preceding claim wherein any of the body parts incorporates at least one slot.

15. A fencing rail fixing tool as claimed in any preceding claim wherein any of the body parts has at least one hole.

16. A fencing rail fixing tool as claimed in any preceding claim wherein any of the body parts has at least one aperture.

17. A fencing rail fixing tool as claimed in any preceding claim wherein at least one of the separate connectable parts incorporates at least one additional lug.

18. A fencing rail fixing tool as claimed in any preceding claim wherein at least one of the separate connectable parts incorporates at least one additional fin.

19. A fencing rail fixing tool as claimed in any preceding claim wherein a lug has a slot to receive the end of a tape measure.

20. A fencing rail fixing tool as claimed in any preceding claim wherein the lug or fin has an aperture.

21. A fencing rail fixing tool as claimed in any preceding claim wherein the lug or fin has a threaded portion.

22. A fencing rail fixing tool as claimed in any preceding claim wherein the lug or fin is hollowed and/or channelled.

23. A fencing rail fixing tool as claimed in any preceding claim wherein said strap has a plurality of holes and/or slots spaced along its length and is made from nylon, textiles materials and/ or metal and metals materials and/or plastic and plastics materials or a compound or combination of these materials.

24. A fencing rail fixing tool as claimed in any preceding claim wherein said elongate body has two or more lugs or fins disposed along it for the purpose of acting as a grip to aid the user in extracting the tool.

25. A fencing rail fixing tool as claimed in any preceding claim wherein the elongate body has an aperture that goes all the way through the body.

26. A fencing rail fixing tool as claimed in any preceding claim wherein any one of a thumb lug has an aperture.

27. A fencing rail fixing tool as claimed in any preceding claim wherein the head is formed in a round or oval shape.

28. A fencing rail fixing tool as claimed in any preceding claim wherein the head is formed in a rectangular shape.

29. A fencing rail fixing tool as claimed in any preceding claim wherein the head is detachable.

30. A fencing rail fixing tool as claimed in any preceding claim wherein the head is connectable to the elongate body by a threaded male and female coupling means.

31. A fencing rail fixing tool as claimed in any preceding claim wherein the head has at least one slot or channel.

32. A fencing rail fixing tool as claimed in any preceding claim having a tip that is detachable.

33. A fencing rail fixing tool as claimed in any preceding claim having a tip that has screw threaded portion to connect the tip to the body.

34. A fencing rail fixing tool as claimed in any preceding claim wherein the head is bulbous in shape to fit into a cupped palm of the user's hand.

35. A fencing rail fixing tool as claimed in any preceding claim wherein the elongate body or any of the parts has one or more holes with a threaded inner to receive a male threaded detachable part.

36. A fencing rail fixing tool as claimed in any preceding claim wherein the prong is detachable and has a threaded portion to connect to the body.

37. A fencing rail fixing tool as claimed in any preceding claim wherein the elongate body has at least one eyed hook that is detachable via a screw in connection to the body.

38. A fencing rail fixing tool as claimed in any preceding claim wherein the lug or fin has at least one prong protruding from it.

39. A fencing rail fixing tool as claimed in any preceding claim wherein the elongate body has at least one lug or fin that has a detachable prong having a screw in connection to the body.

40. A fencing rail fixing tool as claimed in any preceding claim having two straps attached to the body.

41. A fencing rail fixing tool as claimed in any preceding claim having two straps attached to the any of the detachable parts.

42. A fencing rail fixing tool as claimed in any preceding claim having two straps; one strap attached to the body and one strap attached to any of the other parts.

43. A fencing rail fixing tool as claimed in any preceding claim wherein the elongate body shape is triangular in cross section.

44. A fencing rail fixing tool as claimed in any preceding claim wherein any of the detachable parts are interchangeable therefore different combinations of the tool are achieved where different versions may be produced.

45. A fencing rail fixing tool as claimed in any preceding claim wherein the body may have one or more portions bent out of alignment to the rest of the body.

46. A fencing rail fixing tool as claimed in any preceding claim wherein the body has one or more flattened off portions.

* * * * *